US007121195B2

(12) United States Patent
Daniel et al.

(10) Patent No.: US 7,121,195 B2
(45) Date of Patent: Oct. 17, 2006

(54) METHOD AND APPARATUS FOR DRIVING MULTIPLE KNOTTERS

(75) Inventors: Bart Daniel, Kennesaw, GA (US); Scott Shepard, Lubbock, TX (US); Glenn Ellison, Lubbock, TX (US)

(73) Assignee: L&P Property Management Company, South Gate, CA (US)

( * ) Notice: Subject to any disclaimer, the term of this patent is extended or adjusted under 35 U.S.C. 154(b) by 120 days.

(21) Appl. No.: 10/926,443

(22) Filed: Aug. 25, 2004

(65) Prior Publication Data

US 2006/0042481 A1 Mar. 2, 2006

(51) Int. Cl.
*B65B 13/18* (2006.01)
*B65B 13/26* (2006.01)

(52) U.S. Cl. ..... 100/33 R; 100/2; 100/14; 100/26; 140/101

(58) Field of Classification Search ..... 100/2, 100/8, 17, 26, 31, 32, 33 R, 14; 140/93 R, 140/93.6, 101, 118; 289/1.5, 218.1
See application file for complete search history.

(56) References Cited

U.S. PATENT DOCUMENTS 3,528,364 A 9/1970 Freund ..... 100/5
3,720,158 A 3/1973 Sauer et al.
4,611,534 A 9/1986 Kudlicka et al.
5,704,283 A 1/1998 Wiedel ..... 100/3
5,870,950 A 2/1999 Wiedel ..... 100/33
6,283,017 B1 9/2001 Johnson et al. ..... 100/31
6,628,998 B1 9/2003 Stamps et al. ..... 700/90
6,633,798 B1 10/2003 Daniel et al. ..... 700/275
6,637,324 B1 10/2003 Stamps ..... 100/26
6,705,214 B1 3/2004 Stamps
6,711,994 B1 3/2004 Daniel et al. ..... 100/26
6,829,877 B1 * 12/2004 Daniel et al. ..... 53/529

OTHER PUBLICATIONS

Communication Relating to the Results of the Partial International Search dated Jan. 12, 2006.

* cited by examiner

*Primary Examiner*—Lowell A. Larson
*Assistant Examiner*—Jimmy Nguyen
(74) *Attorney, Agent, or Firm*—Husch & Eppenberger, LLC; Grant D. Kang

(57) ABSTRACT

An apparatus for selectively driving a pivotable knotter includes a rack, a pinion in driving communication with the rack, a knotter drive gear connected to the knotter and a linear actuator. The linear actuator is connected to the knotter and pivots the knotter about a pivot axis. Upon pivot, the knotter drive gear is engaged with the rack.

20 Claims, 13 Drawing Sheets

METHOD AND APPARATUS FOR DRIVING MULTIPLE KNOTTERS

CROSS-REFERENCE TO RELATED APPLICATIONS

None.

STATEMENT REGARDING FEDERALLY SPONSORED RESEARCH OR DEVELOPMENT

Not Applicable.

APPENDIX

Not Applicable.

BACKGROUND OF THE INVENTION

1. Field of the Invention

This invention relates generally to wire knotters and, more particularly, to a method and apparatus for individually and selectively driving a plurality of wire knotters.

2. Related Art

Wire baling of bulk materials benefits from increased speed and reduced materials cost through automation. Bulk materials include fibrous bulk materials such as cotton and nylon. Fibrous materials are commonly formed into bales by simultaneous compression and binding. There is a continuing need in the automated baling art to improve the efficiency, reliability and accuracy of the bale binding process.

Baling wire performance requirements vary depending upon the bulk material being baled. Such requirements range from industry standard specifications to general operational parameters, such as minimum speeds required for profitability. The Cotton Council issues standard baling constraints specifying particular ranges for the length of wire around the bale and the tension that the wire must withstand.

Current automated baling machines use an articulated track to guide wire around bales of bulk material, while that bale is under compression. Part of the wire guide track in current automated balers must be removable to a second position after the ends of the baling wire have been tied together, in order to allow ejection of the bale and insertion into the baler of the next unit of material for baling. Material to be baled is typically introduced into the automatic baler under vertical compression. Typical pressures for an industry standard 500 pound, 20 by 54 inch bale are in excess of 300 tons. Horizontal plates called follower blocks apply compression through platens which contact the surface of the cotton or other material being compressed. The platens incorporate slots which run laterally to the longitudinal axis of the bale. The Industry Standard number of binding wires for cotton bales is six. Accordingly, there are six slots in the platens. These allow the baling wire to be wrapped around the bale while it is still under compression. The lateral slots have lateral channels behind them for insertion of wire guide tracks in both the upper and lower platens in automatic balers.

A knotter is connected to each track. Knotters operate internally by a receiving a leading end of a bale wire after it has been driven in a circle around the bale and overlapping that end with the trailing end of the wire that has been cut to the appropriate length. Each wire end is seated in a slot in a gear. The gears in the knotter are arranged to twist the ends in opposite directions, effectively twisting them together in a knot. These gears are driven by a shaft, which is in turn driven from outside.

Current machines, if they are to provide the desired feature of selectively engaging individual knotters, or disengaging other individual knotters, must individually drive each knotter. That is, a separate drive apparatus, typically a servo motor, must be engaged with the knotter drive shaft on each individual knotter. This solution to the problem of selectable individual engagement is obviously quite expensive. There is a need in the art for a more economical method and apparatus for achieving individual engagement selected.

It is not uncommon for a wire being looped around the bulk material to bind up in the track or otherwise misfeed. In this case, it is necessary to remove the bound up wire and retie the bale. Presently, there exists no easy or convenient method for retying the bale. Either the wire can be looped manually which presents some hazard to the operator, or alternatively the tied wires may be cut and the process begun again. There remains a need for an automatic baling apparatus that can correct mis-feeding errors.

U.S. Pat. No. 3,528,364 issued to Freund on Sep. 15, 1970 illustrates the problem in the existing art. The Freund patent discloses an apparatus for tying bales of material after it is compressed in a baling machine. In the Freund device, material is compressed into a bale, wire is looped around the bale, and both ends of the loop are placed in a twisting apparatus. The twisting apparatus consists of a several pinions and a vertical rack. Each pinion includes two diametrically opposed slots, and the loop ends are placed in these slots. When the vertical racks are displaced, the pinions rotate thereby twisting together the two ends of the loop. Because the pinions are in constant contact with the rack it is not possible to knot a single loop of wire.

There remains a need in the art for a more reliable and durable wire knotter drive that is capable of selective engagement of either a single knotter or a plurality of knotters.

SUMMARY OF THE INVENTION

It is in view of the above problems that the present invention was developed. The invention is a knotter drive for individually and selectively driving a plurality of knotters.

The overall apparatus is a bale binder designed to interact with a compression apparatus for forming an unbound bale. The apparatus is comprised generally of a carriage that translates along a rail. In one position, the carriage is withdrawn from engagement with the baling station of the bale compressor, so that the finished bale may be ejected and a new bale inserted. The carriage carries wire drivers, partial guide tracks, grippers, cutters and knotters. In an engaged position, the carriage is proximate to the baling station and in a position to drive wire through a guide track that circles the bale, grip the wire, cut the wire, tension the wire against the bale and then knot the ends of the wire.

The carriage is comprised in part of vertical mounting surfaces on which various components are mounted. In many embodiments, the space between the vertical mounts corresponds to the space between bale wires on a finished bale. The various components are mounted to the vertical mount surfaces. The carriage also has a horizontal shaft parallel with the direction of translation parallel and with the long axis of a bale. This shaft forms a mount on which all knotters will be pivotably mounted.

Parallel with the shaft for pivotal mounting is a series of holes in the vertical mounts of the carriage. The holes form a tunnel therethrough. Into this space is installed a rack that is mounted on rollers so that it may move side to side through the vertical mounting surfaces and generally perpendicular to them. The rack is two sided in that there is a driven rack and drive rack. A single servo motor is mounted to the carriage with the drive gear engaged with the driven rack facing it. The other side of the rack has the drive rack which faces the cotton bale. Each knotter has an outwardly projecting drive shaft with a gear on it. When rotated into position, the gear meshes with the drive rack. Accordingly, when the single servo motor is turned, the rack translates and each knotter that is engaged with the rack is driven for operating its knotting functions.

Engagement is as follows. Engagement is by rotation around the aforesaid shaft. This rotation is achieved by an actuator. In a depicted embodiment, the actuator is pneumatic. The actuator is mounted to the vertical mounts, or elsewhere on the carriage, and also pivotably mounted to the knotter. The actuator mediates rotation of the knotter between an engaged position and a disengaged position. The knotter may also be rotated further away from engagement with the rack in order to tilt it out for maintenance if necessary.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
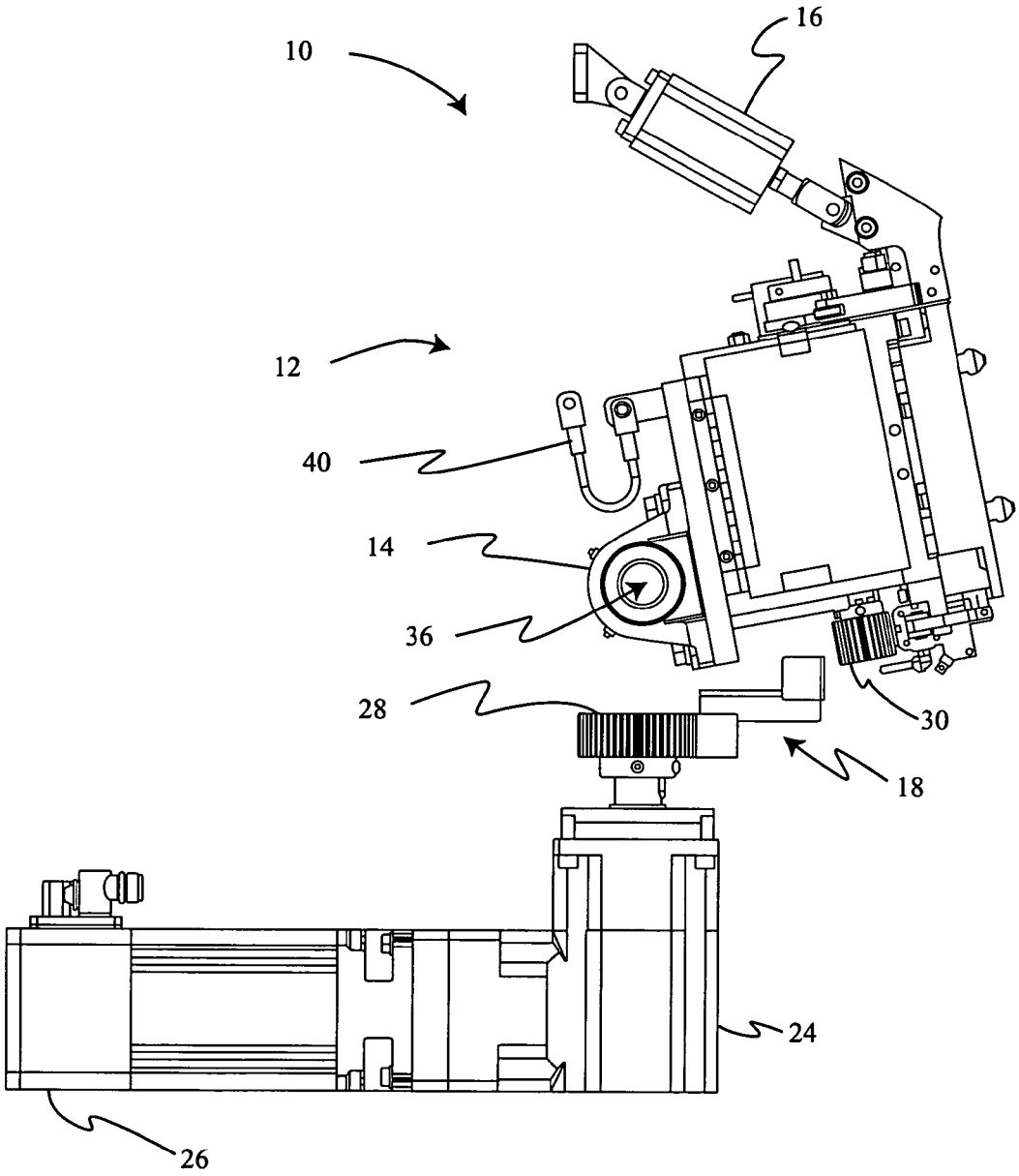
FIG. 1 is a side view of the multiple knotter drive in a first disengaged position.
Figure 2:
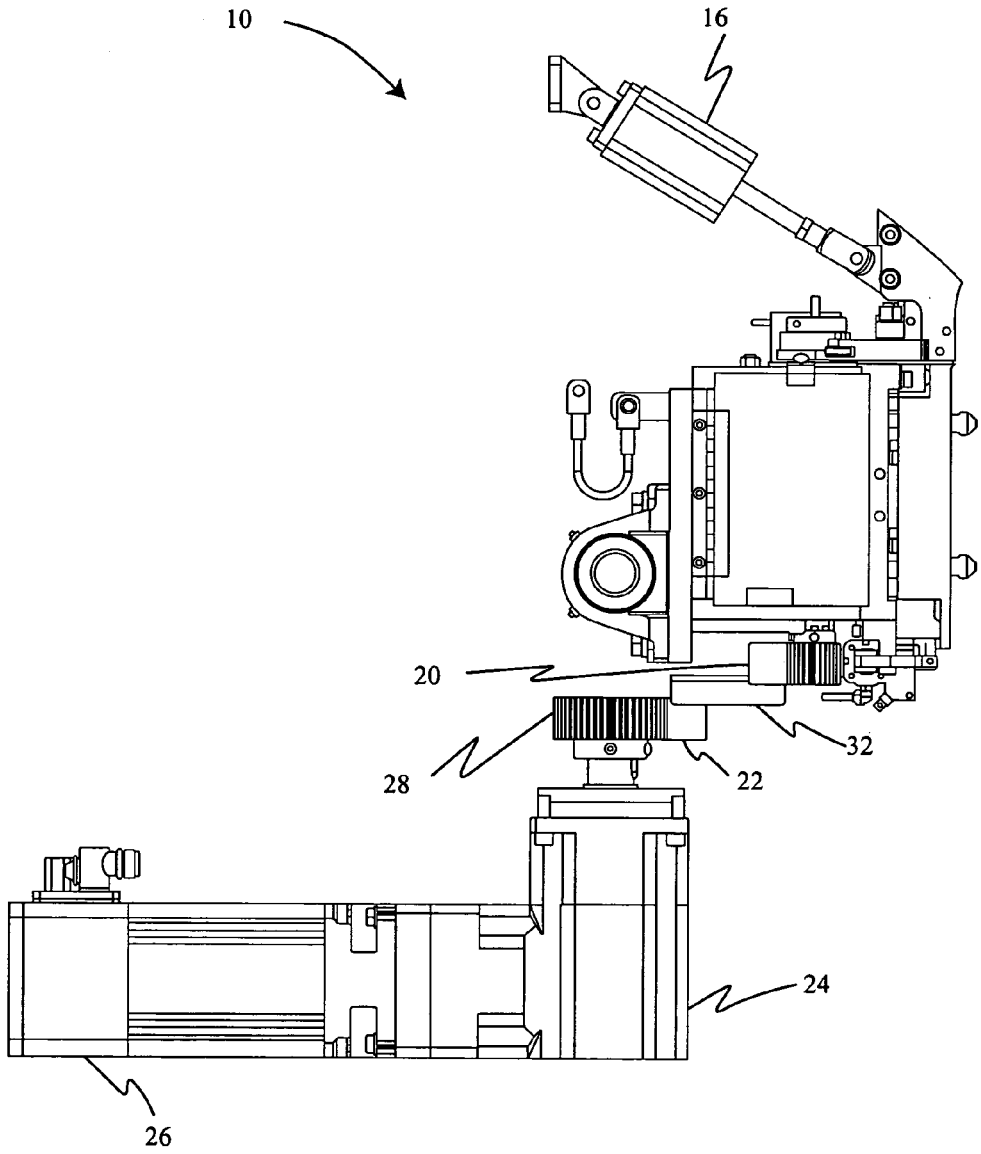
FIG. 2 is a side view of the multiple knotter drive in a second engaged position.

Referring to the accompanying drawings in which like reference numbers indicate like elements. FIGS. 1 and 2 illustrate a multiple knotter drive 10. The multiple knotter drive 10 includes a knotter 12, a bearing 14, and a tilt-out shaft 36. The knotter 12 is a device that, when engaged, twists together two ends of a wire loop wrapped around a bale. The bearing 14 is connected to the knotter 12 and mounted on the tilt-out shaft 36. As such, the knotter 12 is pivotable about the tilt-out shaft 36. A strap 40 is used to limit the degree to which the knotter 12 can pivot. One strap end is attached to the knotter 12 and the other strap end is attached to the carriage. In the event that maintenance is required on either a knotter or the rack, the strap can hold the knotter in a position convenient for maintenance without allowing it to swing freely.

A knotter drive gear 30 is mounted on the knotter 12. In the depicted embodiment, the knotter gear 30 is a 21 tooth gear with a 1.67 inches (42 mm) pitch diameter and an outer diameter of 1.83 inches (47 mm). Turning this gear operates the knotter to fasten wire ends.

A linear actuator 16 is connected to the knotter 12. The linear actuator 16 moves linearly to pivot the knotter 12 about the tilt-out shaft 36. In the embodiment depicted in FIG. 1, the linear actuator 16 is in a first disengaged position, and in the embodiment depicted in FIG. 2, the linear actuator 16 is in a second engaged position. In the depicted embodiments, the linear actuator 16 is an air cylinder; other devices, however, may be used.

The apparatus 10 also includes a servo motor 26, a gear box 24, and a pinion 28. The apparatus 10 further includes a rack 18. The rack is comprised of driven rack 22 and drive rack 20, which are fixed relative to one another. The pinion 28 drives the driven rack 22, and the drive rack 20 turns knotter drive gears 30. In the depicted embodiment, the pinion 28 has 48 teeth, a pitch diameter of 3.82 inches (97 mm), and an outside diameter of 3.98 inches (101 mm). The servo motor 26 provides a rotational input to the gear box 24, and a rotational output of the gear box 24 rotates the pinion 28. In the depicted embodiment, the gear box 24 is a reduction-type gearbox with a ratio of 35:1. In other words, in the depicted embodiment, 35 full rotational inputs by the servo motor 26 results in 1 full rotational output by the gear box 24.

The linear actuator 16 pivots the knotter 12 about the shaft 36 to selectively engage the knotter drive gear 30 with the rack 18. For example, in the first position depicted in FIG. 1, the knotter drive gear 30 is disengaged but engaged in the embodiment depicted in FIG. 2.

Figure 3:
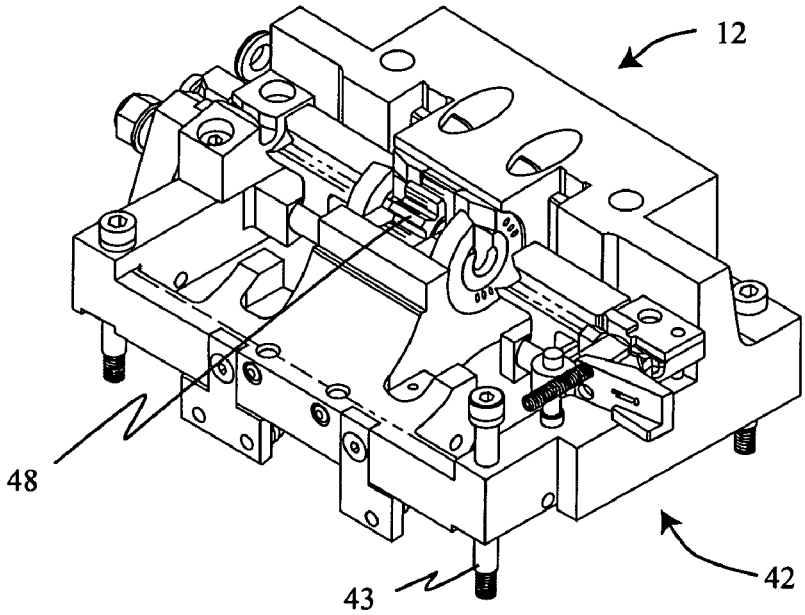
FIG. 3 is an exploded view of the knotter.
Figure 3:
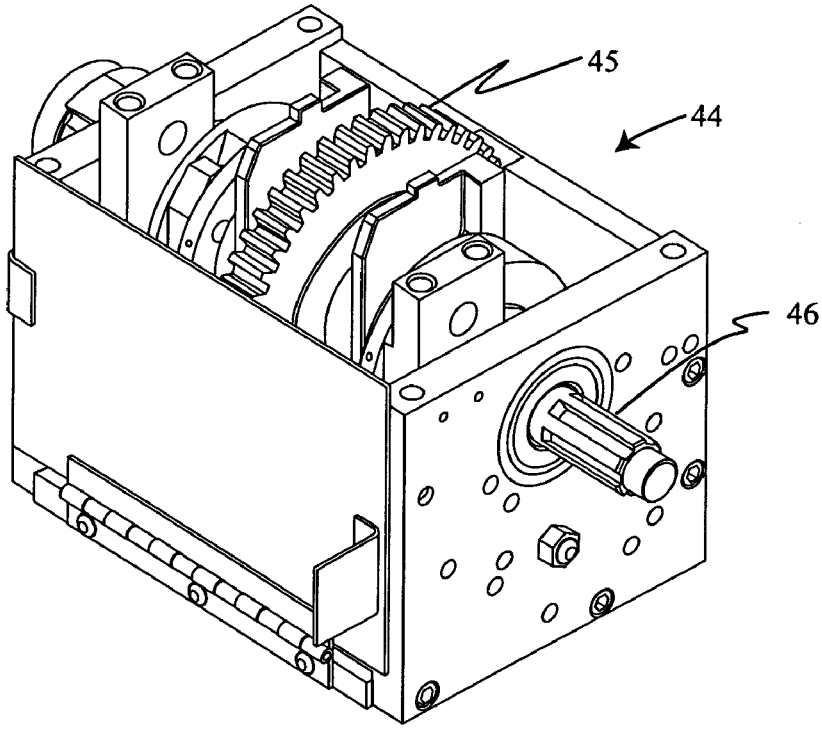

FIG. 3 provides a more detailed view of the knotter 12. The knotter 12 includes a twister housing 42 and a twister main shaft assembly 44. In the depicted embodiment, twister housing 42 and the twister main shaft assembly 44 are connected to one another using screw fasteners but other techniques may be used. The twister housing 42 includes a twister pinion 48. The twister main shaft assembly 44 includes a twister main shaft 46 and a twister drive gear 45. The twister drive gear 45 is connected to the twister main shaft 46. When the twister housing 42 is assembled to the twister main shaft assembly 44, the twister drive gear 45 is in driving communication with the twister pinion 48. The knotter drive gear 30 (not shown in FIG. 3) is adapted for mounting on the twister main shaft 46. In operation, two ends of a wire loop are inserted into the twister housing 42. Then the knotter drive gear 30 rotates the twister main shaft 46, which rotates the twister drive gear 45 and ultimately the twister pinion 48. The rotating twister pinion 48 twists together two ends of a wire loop engaged by it.

Figure 4:
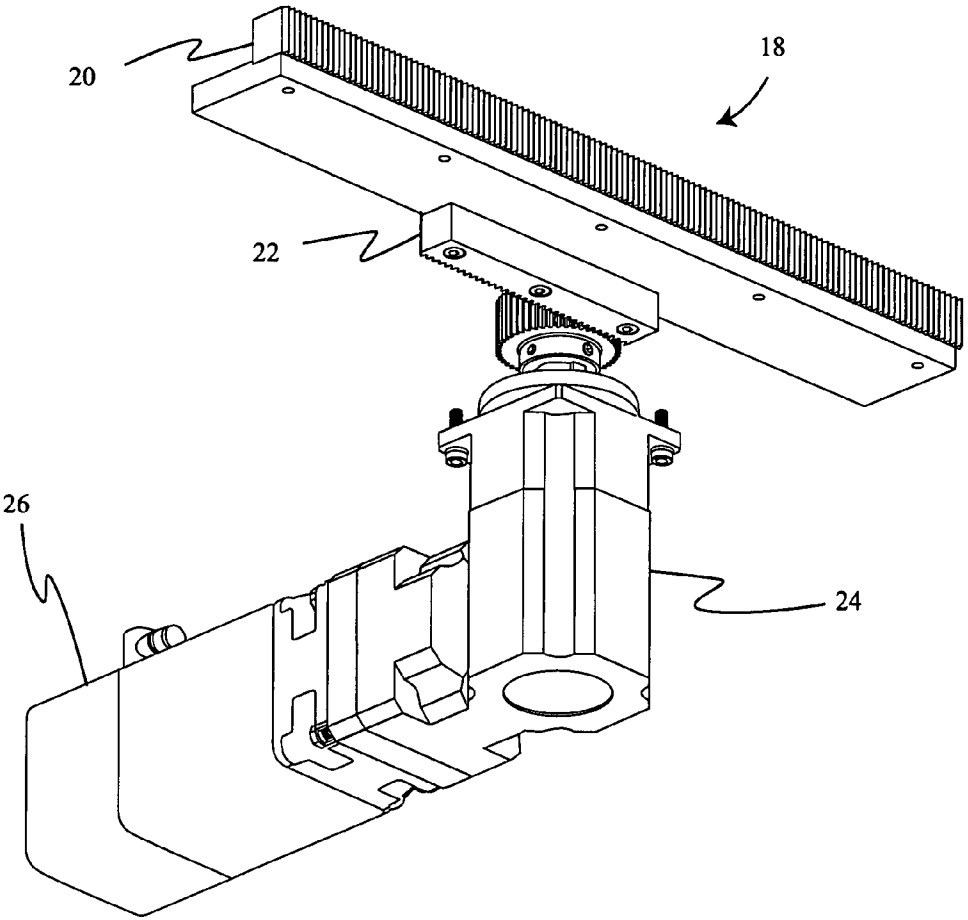
FIG. 4 is a detailed perspective view of the servo motor and gear drive.
Figure 5:
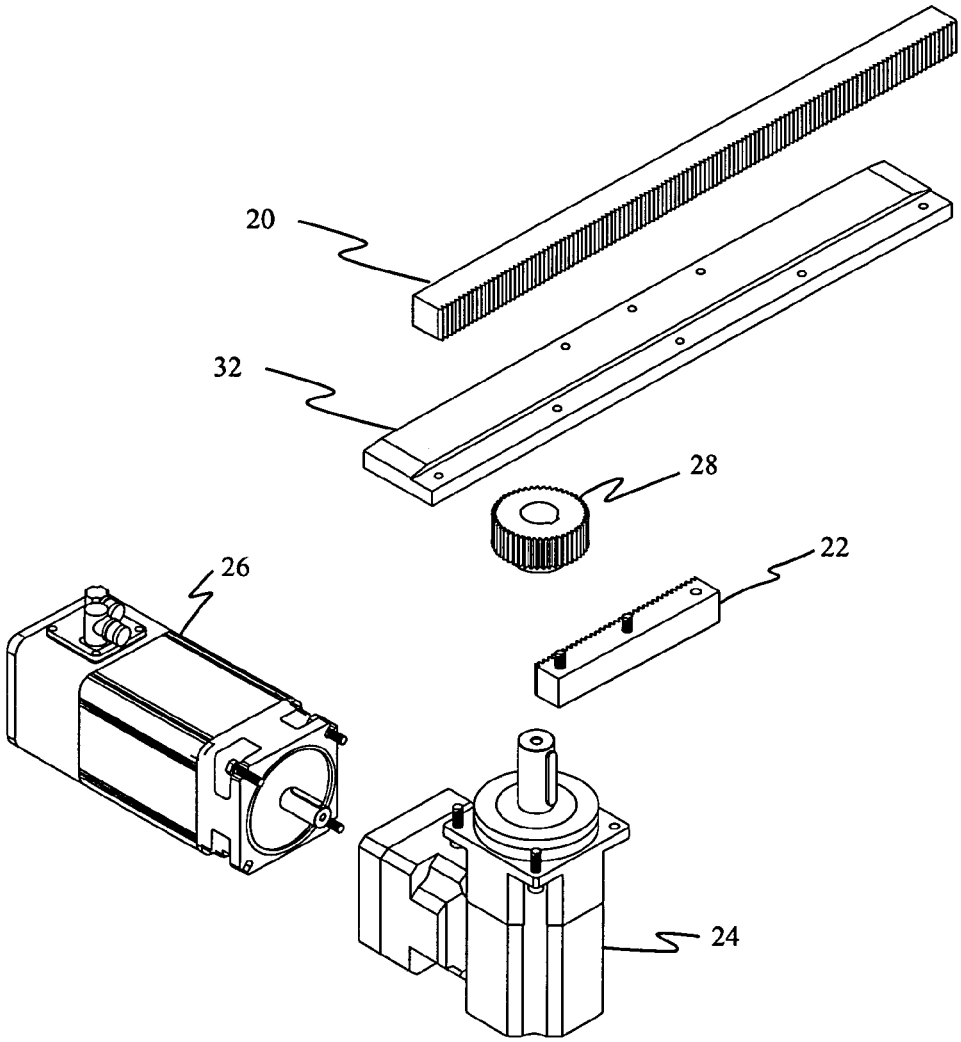
FIG. 5 is an exploded view of the servo motor gear drive and rack.

Referring to FIGS. 4 and 5, a more detailed view of the servo motor 26, gear box 24, and the rack 18 are shown. The rack 18 includes a driven rack 22 and drive rack 20. The drive rack 20 and the driven rack 22 are mounted on a rack bar 32. In the depicted embodiments, the driven rack 22 is 9.25 inches (235 mm) in length, and the drive rack 20 is about 30 inches (762 mm) in length. In the depicted embodiments, the drive rack 20 is mounted offset from the driven rack 22. However, in some embodiments, the drive rack 20 and the driven rack 22 are mounted on the same side of the rack bar 32.

The pinion 28 is mounted on the gear box 24 which is connected to the servo motor 26. The servo motor 26 provides rotational input to the gear box 24 and output of the gear box 24 rotates the pinion 28. The pinion 28 engages the drive rack 22 and moves the rack 18 linearly. In the embodiments depicted in FIGS. 4 and 5, the rack moves linearly about 0.343 inches (8.7 mm) for every full rotational input by the servo motor 26.

Figure 6:
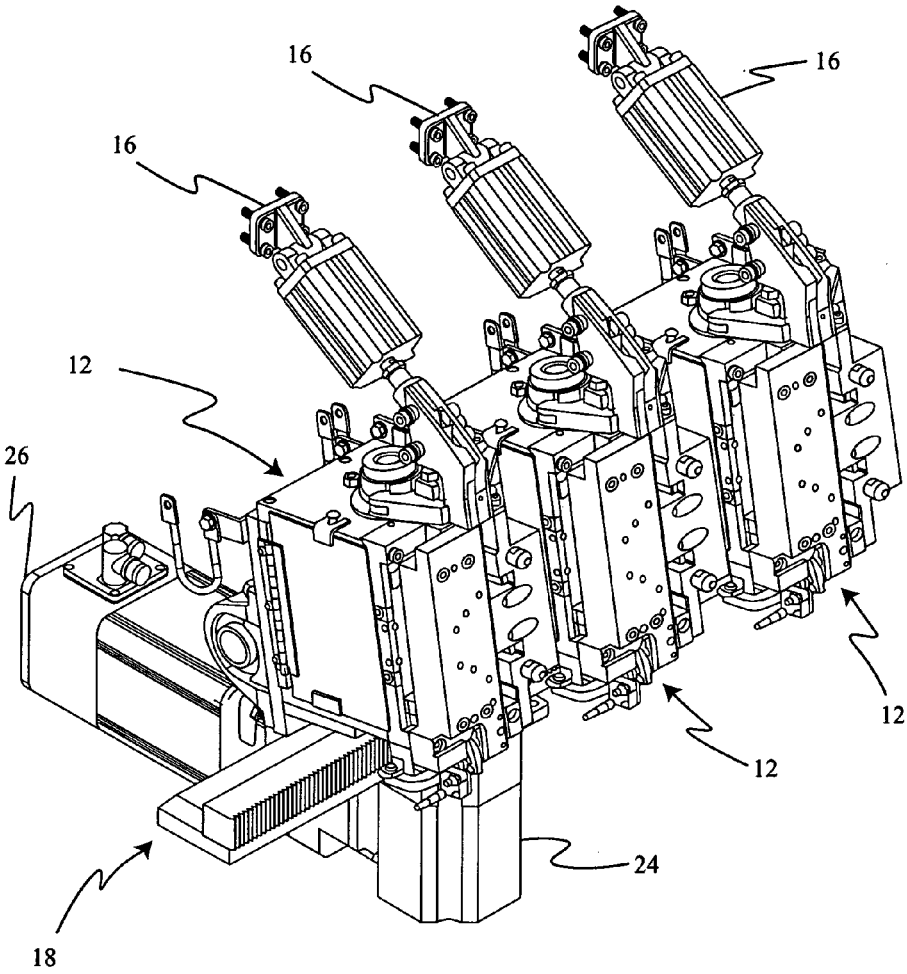
FIG. 6 is an alternative embodiment showing multiple knotters.

In the embodiment depicted in FIG. 6, there are three knotters 12 selectively engageable with the rack 18. While there are three knotters 12 in the depicted embodiment, those skilled in the art will understand a greater or lesser number of knotters can be used. For example, there may be as many as eight or as few as one knotter 12. The knotters 12 are selectively engaged by controlling the operation of the respective linear actuator 16.

Figure 7:
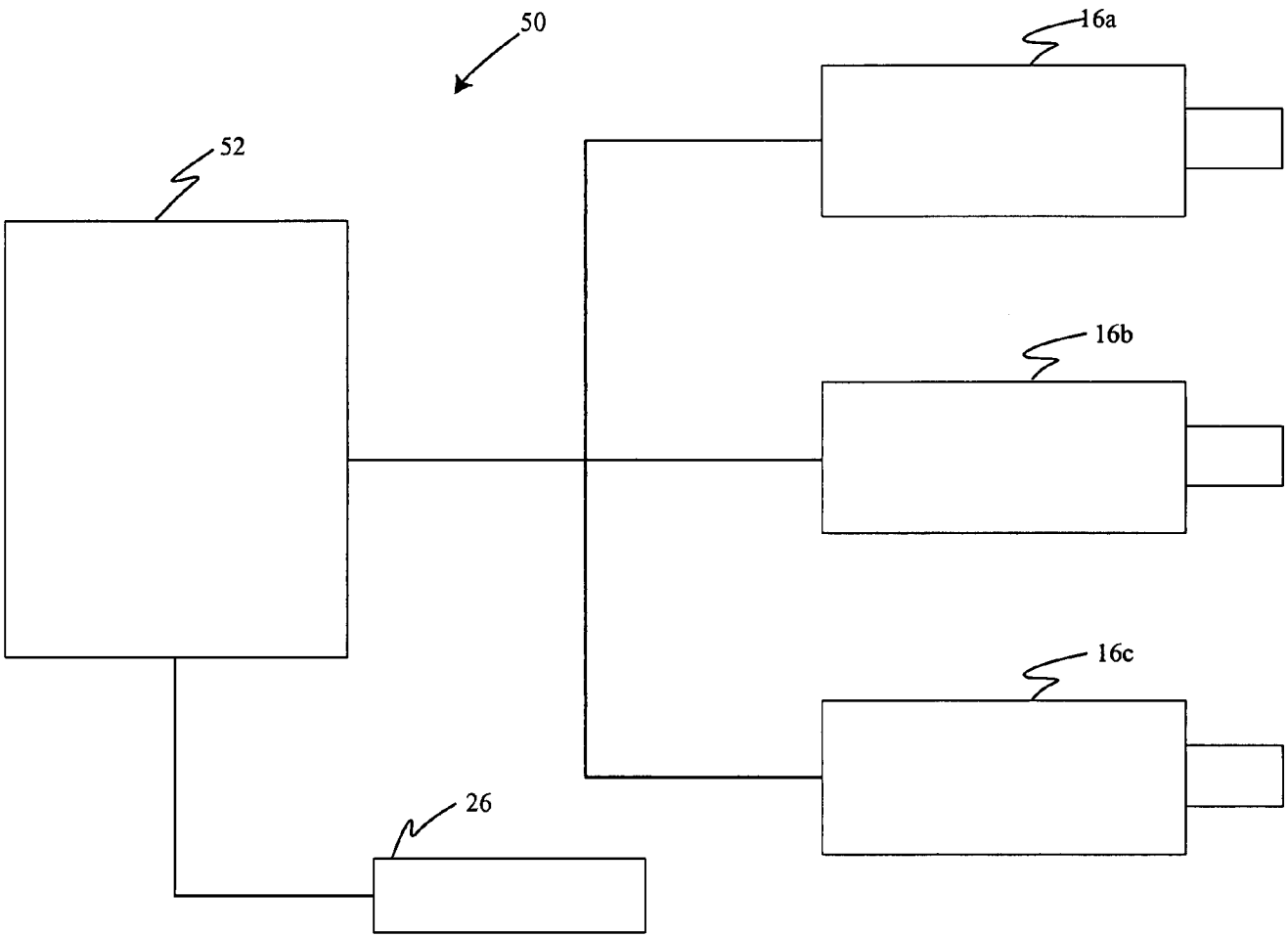
FIG. 7 is a schematic drawing of a control system.

A control system 50 is illustrated in FIG. 7. The control system 50 includes a control module 52. Other components of the control system 50 are described in U.S. Pat. No. 6,628,998 issued to Stamps et al. on Sep. 30, 2003 incorporated herein by reference. The control module 52 is operatively connected to linear actuators 16*a*, 16*b*, 16*c*, and to the servo motor 26. As examples, the control module 52 and the linear actuators 16 may be electrically or pneumatically connected. The control module 52 may receive input directly from an operator or instructions from another machine. The control module 52 selectively engages the linear actuators 16 and the servo motor 26. In one example, the control module 52 engages all three linear actuators 16*a*, 16*b*, and 16*c* and subsequently engages the servo motor 26. In another example, the control module 52 engages only one of the linear actuators, such as 16*b*, and subsequently engages the servo motor 26. In yet another example, the control module 52 engages two of the linear actuators, such as 16*a* and 16*c*, and subsequently engages the servo motor 26. In this manner, the knotters 12 can be selectively engaged. For example, if a wire mis-feeds in a particular track, the wire can be re-strung and the particular knotter can be singularly engaged to tie the re-strung wire. Alternatively, a malfunctioning knotter may be disengaged. Its corresponding bale loops may be knotted by another knotter, which would be indexed into its position as signaled by the controller.

Figure 8:
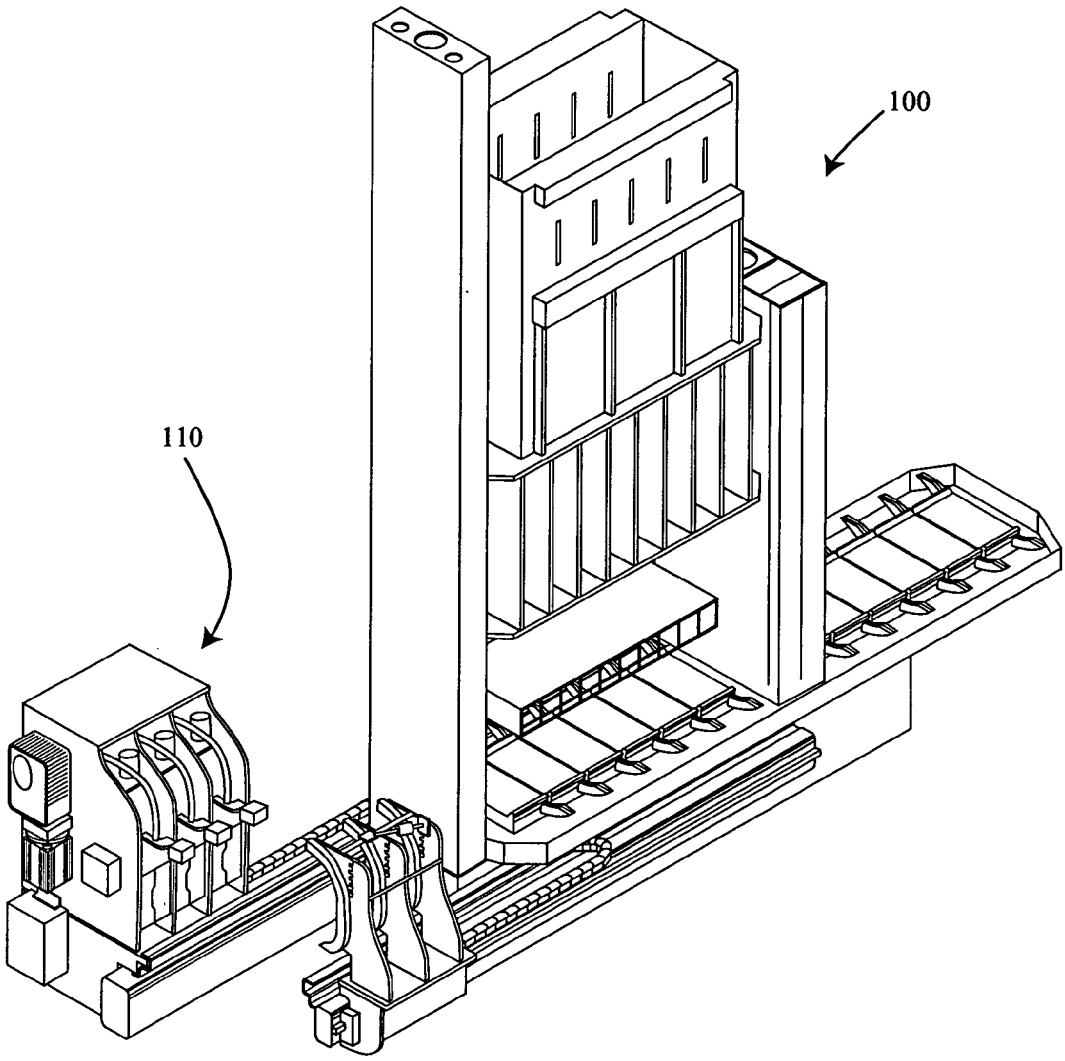
FIG. 8 is a perspective view of a cotton baler.

FIG. 8 illustrates a cotton baling machine 100. As an example only, the multiple knotter drive may be incorporated into a down packing cotton baling machine 100. The multiple knotter drive may also be used with "up packers," or otherwise. The cotton baling machine 100 includes a carriage unit 110, and the carriage unit 110 includes the multiple knotter drive. The controller would also control the knotters themselves.

The carriage rides on a rail. The rail is oriented such that the carriage and the binding equipment mounted on it may be withdrawn from proximity with the press. This allows the finished bale to be ejected and a new volume of compressed bulk material to be delivered to the baling station. Thereafter, the carriage translates across the rail to a position proximate to the baling station, where guide track portions on the carriage and the wire feed drive and knotters of the carriage can engage bale guide track ioops at the baling station.

Figure 9:
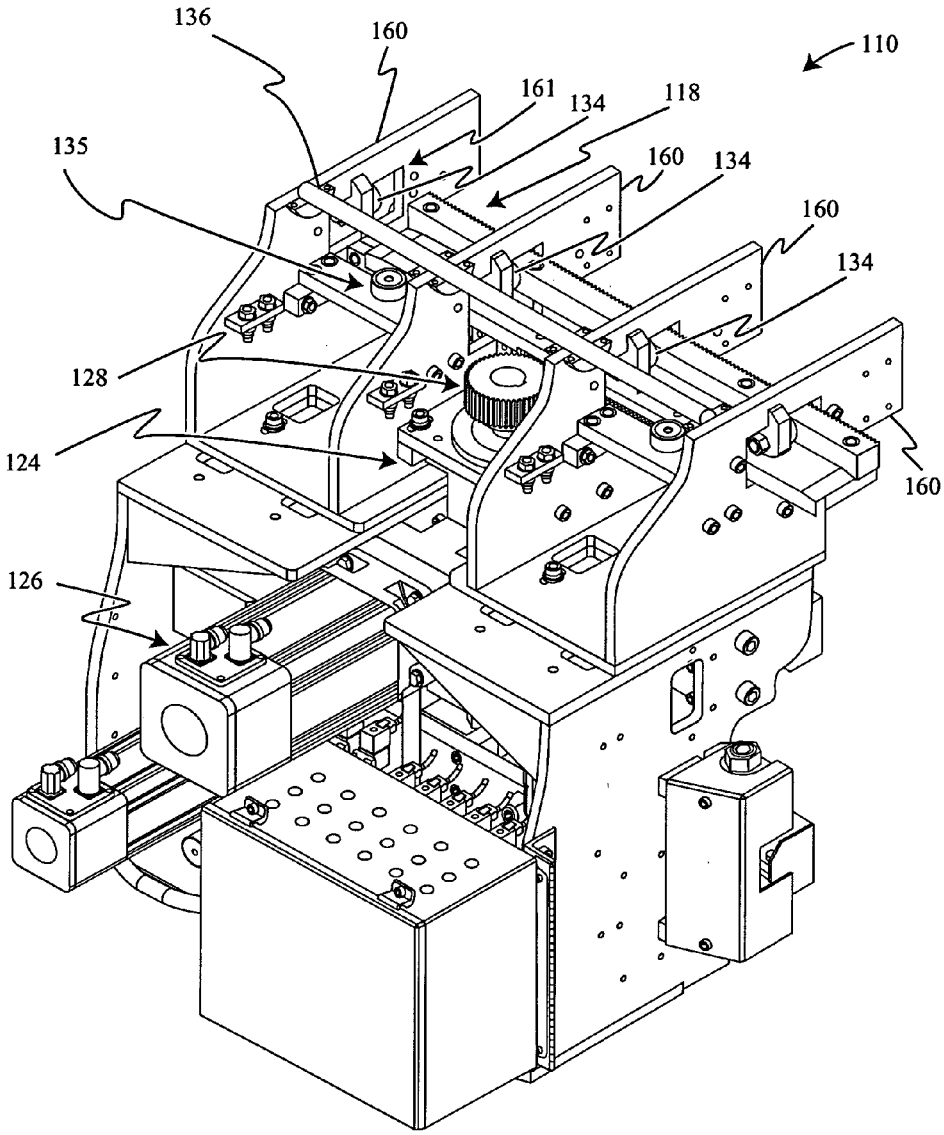
FIG. 9 is a partial perspective view of a carriage unit.
Figure 10:
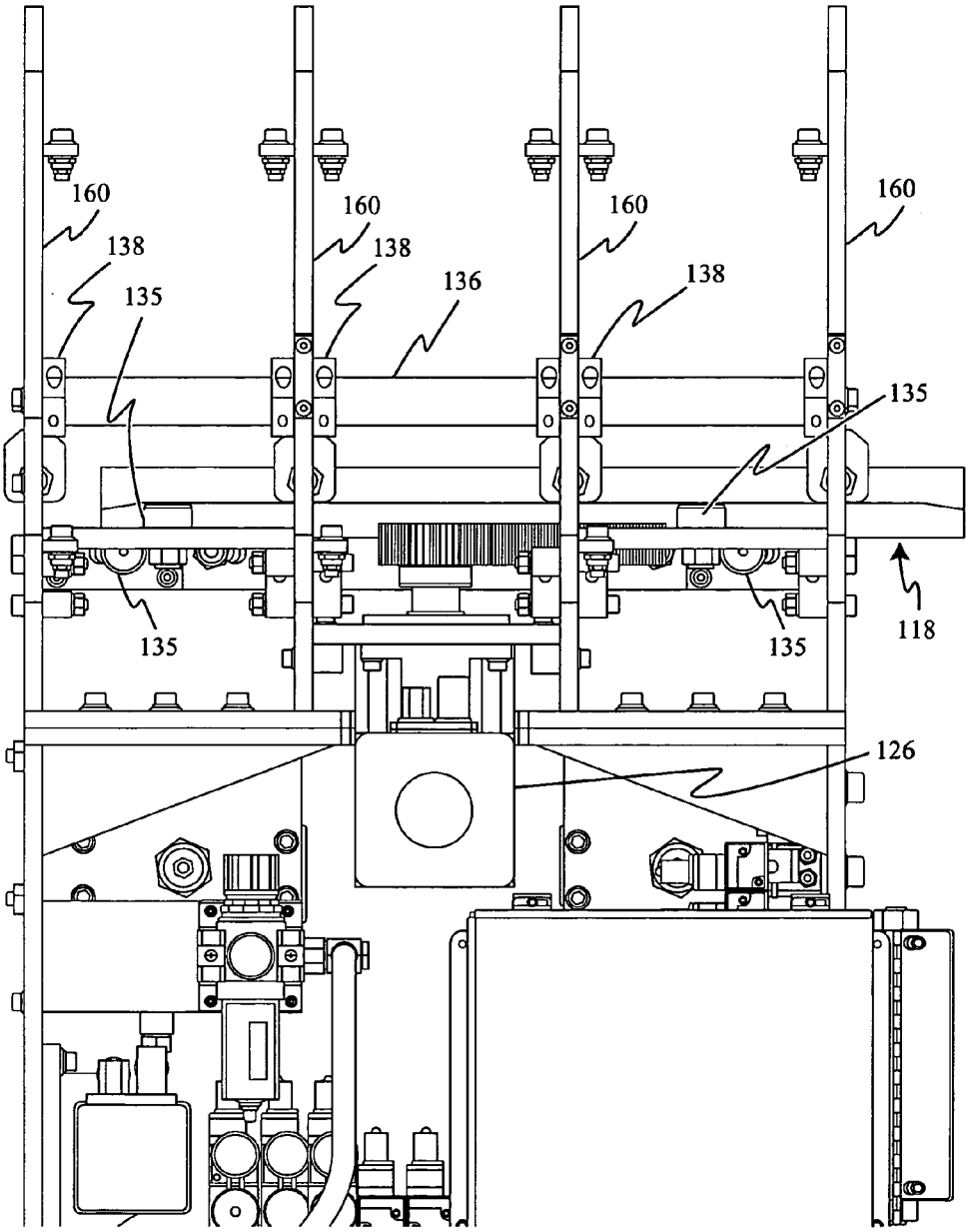
FIG. 10 is a front view of the carriage unit.

FIGS. 9 and 10 provide a more detailed view of the carriage unit 110. The carriage unit 110 includes a servo motor 126, a gear box 124, a pinion 128, and a rack 118. The servo motor 126 provides rotational input to the gear box 124, and the gear box 124 rotates the pinion 128. The pinion 128 is in driving relationship with the rack 118 and moves the rack 118 linearly when the pinion 128 is rotated. The carriage unit 110 also includes plates 160, on which components are mounted. The plates 160 are vertically oriented and each have an opening 161 which receives the rack 118.

As can be seen, the rollers or cam followers 134, 135 are used to mount the rack in a way that allows for its lateral translation. They are oriented both for vertical and horizontal roller axes. The rollers are arranged in any configuration that will allow side to side translation but otherwise restrain the rack from movement in any other direction.

Cam followers 134 are mounted on the plates 160 and are in rolling contact with the rack 118. The cam followers 134 guide and support the rack 118 within the opening 161. Some embodiments may include additional cam followers 135 to further guide the rack 118.

The driven rack is only as long as it needs to be; typical knotters twist the wire ends together seven times, and, this requires a lateral translation of the rack for execution.

Also mounted on the carriage unit 110 is a tilt-out shaft 136. The tilt-out shaft 136 traverses the plates 160 and is held in place by collets 138. The tilt-out shaft 136 is used to support a knotter 112 (best seen in FIG. 11).

Figure 11:
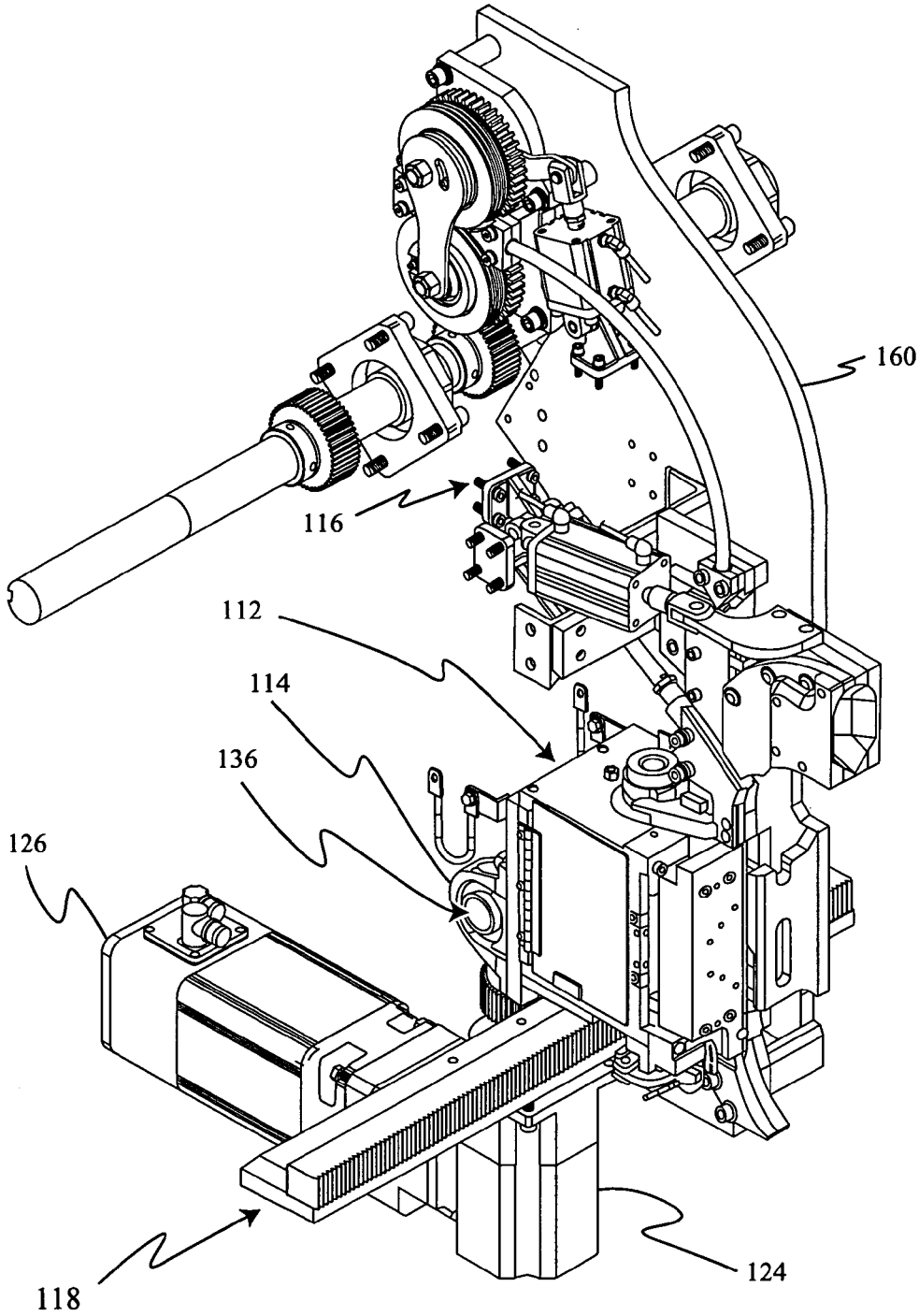
FIG. 11 is a perspective view of the knotter drive.

Referring now to FIG. 11, a bearing 114 is mounted on the knotter 112, and the bearing 114 is connected to the tilt-out shaft 136. In this manner, the knotter 112 is pivotable about the tilt-out shaft 136. A linear actuator 116 (best seen in FIGS. 12 and 13) is connected to the knotter 112.

The linear actuator is mounted in any convenient place on the carriage. The actuator may be mounted to the vertical plates 160. It may be hingedly mounted to facilitate a rotational motion of the knotter. The opposite end of the actuator 116, the piston arm, is hingedly mounted to the knotter.

In FIG. 11, the knotter engagement actuator 116 is obscured by an overlying actuator. This is the actuator for the guide track, which is hingedly mounted and may be laterally displaced.

Figure 12:
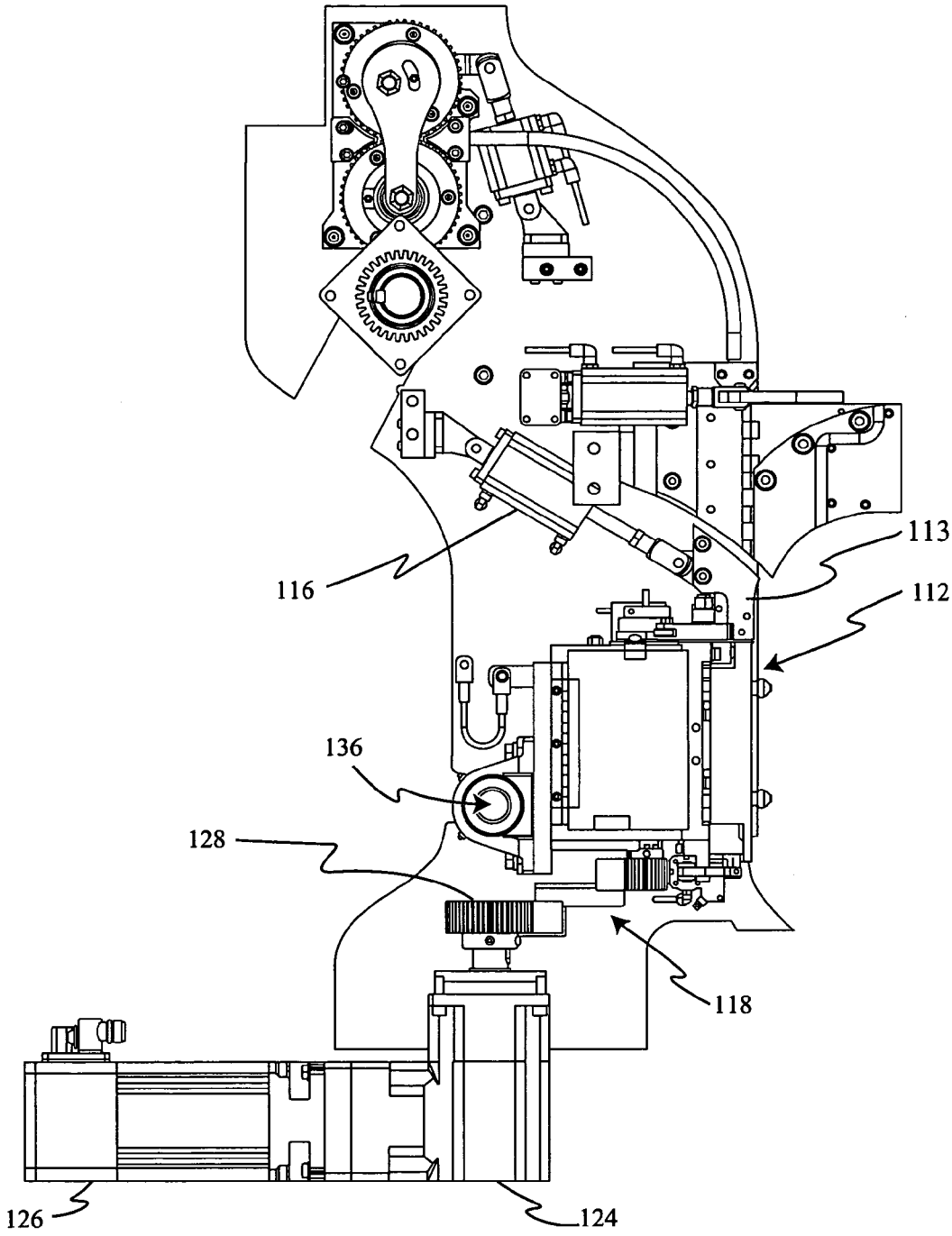
FIG. 12 is a side view of the knotter drive in a second engaged position.
Figure 13:
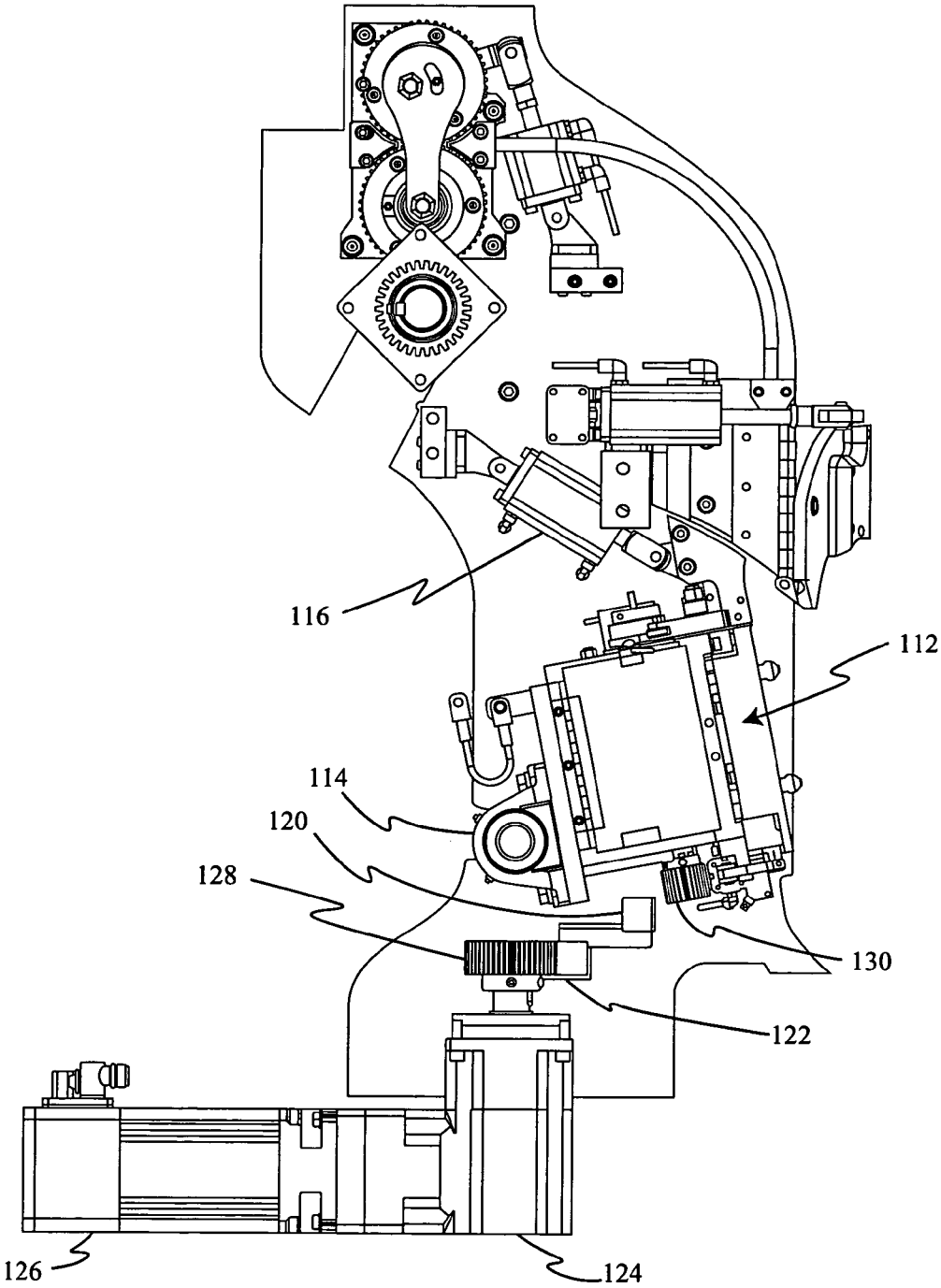
FIG. 13 is a side view of the knotter drive in a first disengaged position.

FIGS. 12 and 13 respectively illustrate a first and second position of the linear actuator 116. In the first position, the linear actuator 116 is retracted. In the second position, the linear actuator 116 is extended.

The rack 118 includes a driven rack 122 and a drive rack 120. The driven rack 122 engages the pinion 128, and the drive rack 120 selectively engages a knotter drive gear 130. The knotter drive gear 130 is placed in a driven relationship with the drive rack 120 when the linear actuator 116 is in the second extended position and is removed from the driven relationship when the linear actuator 116 is placed in the first position. In the first position, there is about 0.4 inches (11 mm) of clearance between the drive rack 120 and the knotter drive gear 130.

In operation, the linear actuator 116 is engaged such that it pivots the knotter 112 about the tilt-out shaft 136 thereby engaging the knotter drive gear 130 with the drive rack 120. Thereafter, the servo motor 126 is engaged. When the servo motor 126 is engaged, the servo motor 126 rotates an input of the gear box 124 such that the gear box 124 rotates the pinion 128. The pinion 128 moves the rack 118 linearly such that knotter drive gear 130 is rotated. Accordingly, operation of the servo motor 126, when the knotter drive gear 130 is in communication with the drive rack 120, causes the knotter 112 to knot the ends of the wire loop which is wrapped around the bale.

The knotter has mounted upon it an entry section of guide track. This section of guide track receives a leading end of a wire that has been driven in circle around the bale. This end is received from a next preceding guide track portion. The knotter guide track portion 113 (FIG. 12) has a curved engagement face, in order to accommodate the rotation of the knotter assembly out of engagement with the rack. Further disengagement of the knotter assembly by rotation around the mounting shaft 136 allows greater access for maintenance, particularly in light of the removal with the knotter of the aforesaid section of guide track.

There is also provided a method of assembling an apparatus for selectively driving a pivotable knotter. The method includes the steps of: providing a tilt-out shaft; pivotably mounting at least one knotter on the tilt-out shaft; providing a rack; placing a pinion in driving communication with the rack; connecting a knotter drive gear to the pivotable knotter; and connecting a linear actuator to the pivotable knotter, the linear actuator adapted to pivot the pivotable knotter from a first engaged position to a second disengaged position such that lateral movement of the rack drives all knotters that are in the engaged position.

There is provided a method of selectively engaging a pivotable knotter. The method includes the steps of: providing a rack; providing a servo motor in a driving relationship with the rack; connecting a knotter drive gear to the pivotable knotter; connecting a linear actuator to the pivotable knotter; actuating the linear actuator such that said knotter drive gear engages the rack; and engaging the servo motor such that the rack moves linearly and rotates the knotter drive gear. In some embodiments, the method further includes the step of selecting a linear actuator for engagement via a control module.

Should an individual knotter or the rack require maintenance, the actuator can be engaged to withdraw the knotter for maintenance. The actuator may be disengaged and the knotter held in a convenient position for maintenance by strap 140. A degree of disengagement for maintenance may be greater than a simple disengagement due to malfunction to be maintained during continued baling operations with the other functioning knotters.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. An apparatus for selectively driving a wire knotter for a bulk material baler comprising:

a. a mount;

b. a rack disposed to translate laterally in relation to said mount;

c. a rack driver in driving communication with said rack;

d. a wire knotter having a drive gear said wire knotter being pivotably mounted on said mount; said wire knotter having an engaged position and a removed position on said engaged position having said drive gear in driveable engagement with said rack;

e. a guide track portion fixedly attached to said knotter; and f. an actuator operatively connected to said mount and to said wire knotter to mediate travel of said wire knotter between said engaged position and said removed position.

2. The apparatus according to claim 1, wherein said actuator is an air cylinder.

3. The apparatus according to claim 1, wherein said wire knotter is pivotably mounted on a shaft, said shaft being fixed to said mount.

4. The apparatus according to claim 1, wherein said rack driver is a servo motor.

5. The apparatus according to claim 4, further comprising a gearbox connected to said servo motor and in driving communication with said rack.

6. The apparatus according to claim 1, wherein said rack comprises a driven rack operatively engaged with said rack driver and a drive rack operatively engageable by said drive gear of said wire knotter.

7. The apparatus according to claim 1, wherein said rack is supported on said mount with a plurality of rollers, said rollers retaining said rack in two directions orthogonal to a direction of said lateral translation.

8. The apparatus according to claim 6, wherein said drive rack opposes said driven rack.

9. A bale binding apparatus comprising:

a carriage;

a rack, said rack comprising a driven rack and a drive rack and said rack being mounted to translate laterally relative to said carriage;

a rack driver operatively engaged with said rack;

a plurality of wire knotters, each having a knotter drive gear, each of said wire knotters having an engaged position and a disengaged position; said engaged position having said drive gear drivably meshed with said drive rack; and a plurality of actuators, each actuator operatively connected to a corresponding one of said plurality of wire knotters, whereby actuation of one of said plurality of actuators puts said corresponding one of said plurality of wire knotters in said engaged position such that said corresponding one of said wire knotters knots when said rack translates laterally.

10. The apparatus according to claim 9, wherein each of said plurality of actuators is an air cylinder.

11. The apparatus according to claim 9, further comprising a tilt-out shaft and wherein each of said plurality of wire knotters is pivotably connected to said tilt-out shaft.

12. The apparatus according to claim 9, wherein said rack driver is a servo motor.

13. The apparatus according to claim 9, further comprising a gearbox operatively engaging said rack driver with said rack.

14. The apparatus according to claim 9, wherein there are three wire knotters.

15. The apparatus according to claim 12, further comprising a control system operatively connected to said servo motor and said plurality of actuators.

16. The apparatus according to claim 9, further comprising a plurality of rollers in rolling contact with said rack.

17. The apparatus according to claim 9, wherein said driven rack opposes said drive rack.

18. A method of assembling an apparatus for selectively driving a pivotable knotter, said method comprising the steps of:

providing a tilt-out shaft on a carriage;

pivotably connecting at least two knotters on said tilt-out shaft;

mounting a rack on said carriage such that said rack may translate laterally;

engaging a rack driver in driving communication with said rack;

connecting an actuator to each of said knotters, each of said actuators adapted mediating travel of one of said knotters to and from a first position and a second position, said first position being engaged with said rack.

19. A method of selectively engaging a pivotable knotter, said method comprising the steps of:

a. providing a rack;

b. providing a servo motor in a driving relationship with said rack;

c. connecting a knotter drive gear to the pivotable knotter;

d. connecting a linear actuator to said pivotable knotter;

e. actuating said linear actuator such that said knotter drive gear engages said rack; and f. engaging said servo motor such that said rack moves linearly and rotates said knotter drive gear.

20. The method according to claim 18, further comprising the step of selecting an actuator for engagement via a signal from a control module.

* * * * *